US011746494B2

(12) United States Patent
Cannon

(10) Patent No.: US 11,746,494 B2
(45) Date of Patent: Sep. 5, 2023

(54) GEOMEMBRANE LINING SYSTEM HAVING WELD AREAS ADJACENT SIDE EDGES OF RESIN SHEETS AND PROTECTIVE RELEASE FILMS RELEASABLY COVERING THE WELD AREAS

(71) Applicant: AGRU/AMERICA, Inc., Georgetown, SC (US)

(72) Inventor: Rick Cannon, Georgetown, SC (US)

(73) Assignee: Agru America Inc., Georgetown, SC (US)

( * ) Notice: Subject to any disclaimer, the term of this patent is extended or adjusted under 35 U.S.C. 154(b) by 0 days.

(21) Appl. No.: 17/176,816

(22) Filed: Feb. 16, 2021

(65) Prior Publication Data

US 2022/0259813 A1 Aug. 18, 2022

(51) Int. Cl.
*E02D 31/00* (2006.01)

(52) U.S. Cl.
CPC ..... *E02D 31/004* (2013.01)

(58) Field of Classification Search
CPC ..... E02D 31/004; B32B 7/12; E04D 5/148; E04D 5/142; E04D 5/149; B29C 66/435; E04B 1/665
See application file for complete search history.

(56) References Cited

U.S. PATENT DOCUMENTS

| | | | | |
|---|---|---|---|---|
| 4,767,658 | A * | 8/1988 | Lorenz | B29C 66/4722 428/192 |
| 6,053,662 | A * | 4/2000 | Scuero | E02B 7/02 405/107 |
| 6,264,400 | B1 * | 7/2001 | Gent | A01G 13/0287 405/129.75 |
| 9,212,488 | B1 * | 12/2015 | McGraw | B32B 25/10 |
| 9,783,980 | B2 * | 10/2017 | Snyder | E04D 11/02 |
| 2001/0001683 | A1 * | 5/2001 | Mathieson | D06H 5/00 428/57 |
| 2010/0003443 | A1 * | 1/2010 | Kalwara | B32B 27/08 428/41.8 |
| 2010/0024955 | A1 * | 2/2010 | Kalwara | E04D 5/148 428/41.3 |
| 2019/0177990 | A1 * | 6/2019 | Rus | B31F 5/06 |

* cited by examiner

*Primary Examiner* — Carib A Oquendo
(74) *Attorney, Agent, or Firm* — Gerald E. Hespos; Michael J. Porco

(57) ABSTRACT

The invention relates to a geomembrane lining system and method of assembly in which a protective release seal is provided on the weld edges of a geomembrane liner. Geomembrane liners are arranged to line a containment area. Adjacent liners are arranged to partially overlap one another. The side edge of the geomembrane liner have a protective release film over areas of the liners that are to be welded. The protective release film protects the weld edge from accumulating dust and debris prior to and during installation. Dust and debris may disrupt the weld seam and allow contained waste material to leach into the surrounding area. The protective release film is removed prior to or during a welding operation. As a result, the adjacent geomembrane liners are welded together while minimizing or eliminating the presence of dust and debris at the weld edge.

4 Claims, 2 Drawing Sheets

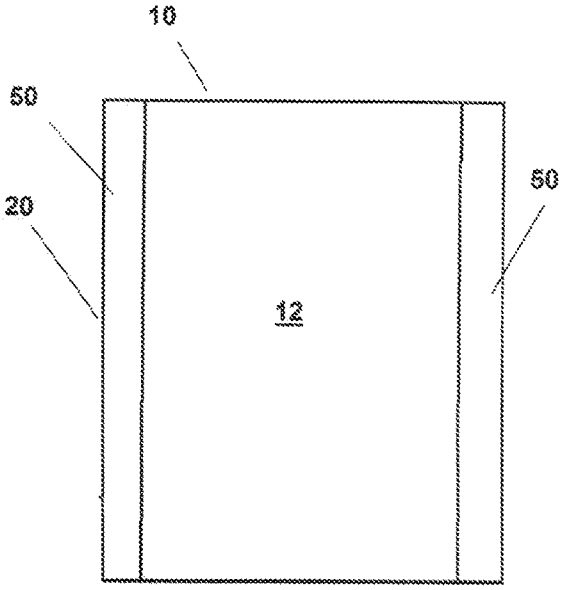
FIG. 1
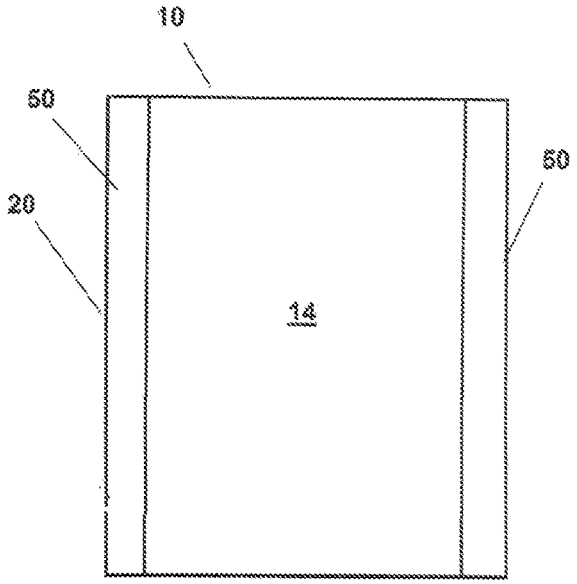
FIG. 2
FIG. 3
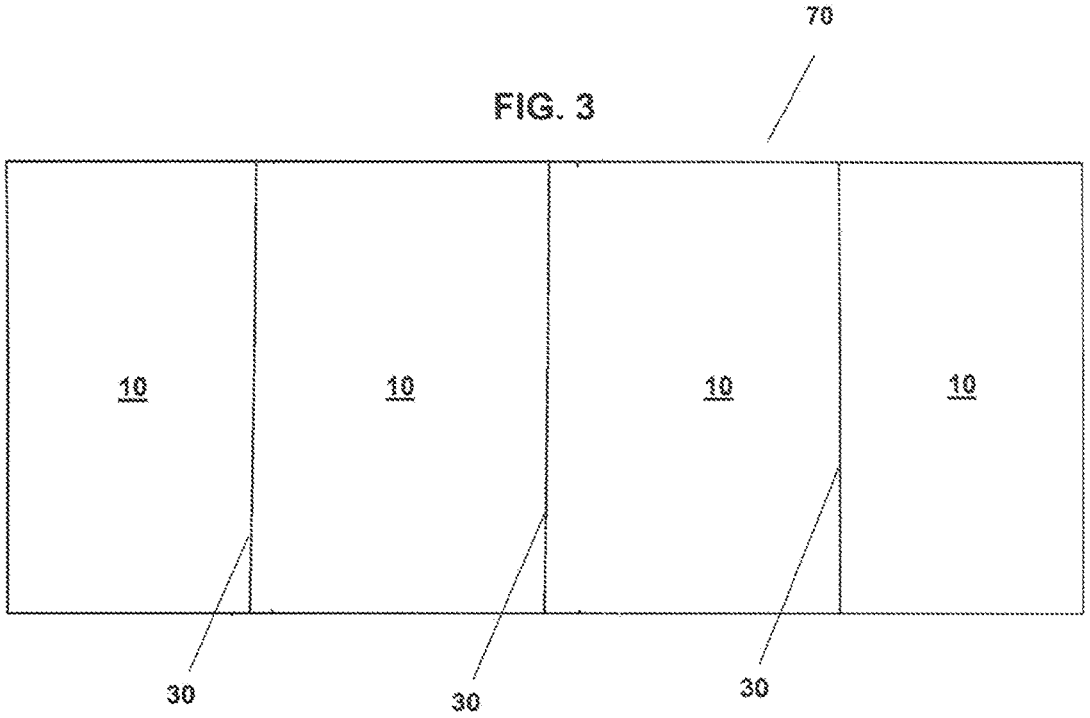

GEOMEMBRANE LINING SYSTEM HAVING WELD AREAS ADJACENT SIDE EDGES OF RESIN SHEETS AND PROTECTIVE RELEASE FILMS RELEASABLY COVERING THE WELD AREAS

BACKGROUND

1. Field of the Invention

The invention relates to a geomembrane liner with a protective seal.

2. Description of the Related Art

The disposal of waste materials presents design challenges to environmental engineers, landfill operators, and manufacturers and producers of goods. In particular, waste materials must be disposed of in a manner that protects the environment in surrounding areas from contamination.

Many waste products may be treated to negate their environmental impact. Other waste materials cannot be treated or must be held for a period of time in a holding area. Such holding areas or landfills are typically lined with a material, such as a geomembrane liner, to prevent the waste products from leaching into the underlying soil and potentially contaminating ground water. The geomembrane liners consists of a plurality of liner sheets welded together at seams to adequately cover a landfill, pond, drainage system, or other holding areas. The liners may be formed from High Density Polyethylene Resin (HDPE), Very Low Density Polyethylene (VLDPE), Linear Low Density Polyethylene (LLDPE), and other materials that prevent waste materials from leaching into surrounding areas. Welding systems are used to join the plurality of liners at the landfill or treatment site prior to the introduction of the waste material.

The weld between adjacent liner panels are tested at multiple positions along the seam to ensure a successful weld. However, soil, dust, and other debris may contact the areas of the liner panels prior to a welding operation, thereby disrupting the seal and leading to contamination of the surrounding environment. As a result, the welding operation may need to be performed again, delaying the completion of a lining project.

Contamination of a seal area by particulate matter, such as soil, dust, or debris, can occur under several different conditions. However, contamination is most likely to occur at sites having elevated dust conditions, such as phosphate production operations, coal ash storage operations, and precious metal mining operations. Geographically, dry and windy sites, including many portions of the Western United States, pose a challenge for liner seals and welding operations. Finally, liners held in a rolled state at a site having a high dust content are likely to accumulate particulate matter prior to installation.

The negative impacts of dust and debris on seams are well understood. Areas of the liners that are to be sealed must be cleaned prior to a welding operation. However, it is difficult and costly to reduce contamination of fine particles at seam areas, such as coal ash residuals for fine subgrade soils. The build-up of dust and debris in seam areas may reduce the effectiveness of the seal at the time of installation or over a period of time. As a result, the waste material may leach into the surrounding area and negatively impact the surrounding area. The environmental impact of a breached containment system, along with the costs associated therewith, are well known.

In view of the above, an object of the invention to provide a geomembrane sealing and containment system in which the build-up of dust and debris at a seam between adjacent geomembrane liners is mitigated.

A further object of the invention is to provide a method of installing a geomembrane sealing and containment system while mitigating the build-up of dust and debris at a seam between adjacent geomembrane liners.

SUMMARY OF THE INVENTION

The invention relates to a geomembrane lining system and method of assembly in which a protective release seal is provided on the weld edges of a geomembrane liner. The disclosed lining system is particularly well suited for projects or locations with elevated dust conditions, such as phosphate production operations, coal ash storage operations, and precious metal mining operations, dry and windy weather conditions, and/or when liners must be held on site and exposed to the environment for an extended period of time. A plurality of geomembrane liners are provided and may be formed from High Density Polyethylene Resin (HDPE), Very Low Density Polyethylene (VLDPE), Linear Low Density Polyethylene (LLDPE), and other materials that prevent waste materials from leaching into surrounding areas. Individual geomembrane liners are arranged to line a containment area, such as a landfill or a slurry pond. Adjacent liners are arranged to partially overlap one another. Overlapping areas are welded together using a known welding system, such as an Agru SP 110-S V3 or Agru SP 250-SV3 welding machine. The welding machine is moved along the overlapping areas of the adjacent liners to create a seam.

Each of the geomembrane liners comprises opposed upper and lower surfaces and side edges extending continuously along the upper and lower surfaces. At least one of the side edges of each geomembrane liner is provided with a protective release film. The side edge of the geomembrane liner having a protective release film is defined as a weld edge.

The protective release film is applied to the geomembrane liner during manufacture of the liner and prior to shipment and installation at the containment site. The protective release film may be applied to both the upper and lower surfaces of the geomembrane liner at the weld edge. Alternatively, the protective release film may only be applied to one of the upper and lower surfaces. In particular, the protective release film may be applied to the upper surface of the weld edge of a first liner and the lower surface of the weld edge a second adjacent liner facing the upper surface of the weld edge of the first liner. In other words, the protective release film may optionally be applied only to surfaces of the liners that are sandwiched together during the welding operation.

The protective release film protects the weld edge from accumulating dust and debris prior to and during installation. Dust and debris may disrupt the weld seam and allow contained waste material to leach into the surrounding area. The protective release film is removed prior to or during a welding operation. As a result, the adjacent geomembrane liners are welded together while minimizing or eliminating the presence of dust and debris at the weld edge.

The invention further includes a method of installing geomembrane liners having a protective release film. The method comprises a first step of arranging a plurality of geomembrane liners having protective release films on weld edges thereof over a containment area, with weld edges of adjacent liners at least partially overlapping one another. In a second step, a welding machine is arranged at a position to weld the weld edges of the adjacent geomembrane liners to each other. In a third step, the protective release film is removed from the weld edges of the geomembrane liner. In a fourth step, the adjacent liners are welded together using known methods and known welding equipment to form an impermeable seam to prevent the distribution of waste material into surrounding areas.

In an alternative to the method described above, the protective release film may be removed incrementally or in sections during the welding step to reduce exposure of the weld edge of the geomembrane liner to field conditions and therefore further reduce the possibility of accumulation of dust and debris at the weld edges.

BRIEF DESCRIPTION OF THE DRAWINGS

FIG. 1 is a top plan view of a geomembrane liner having a protective release film on an upper surface thereof.

FIG. 2 is a bottom plan view of a geomembrane liner having a protective release film on a lower surface thereof.

FIG. 3 is a top plan view of a geomembrane liner containment system.

DETAILED DESCRIPTION

Figure 4:
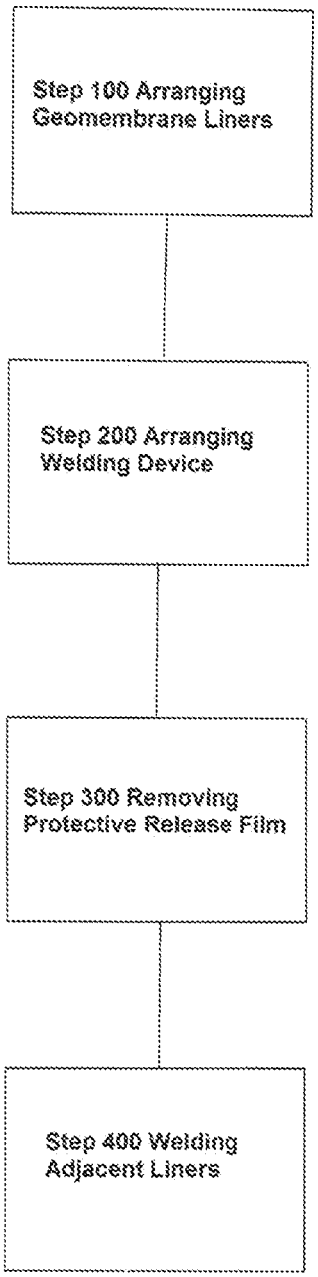
FIG. 4 is a flow chart of a method of installing a geomembrane liner containment system.

Preferred embodiments of the present disclosure will be described hereinbelow with reference to the accompanying drawings. In the following description, well-known functions or constructions are not described in detail to avoid obscuring the present disclosure in unnecessary detail.

The invention relates to a geomembrane lining system and method of assembly in which a protective release seal is provided on the weld edges of a geomembrane liner. A plurality of geomembrane liners 10 are provided and may be formed from High Density Polyethylene Resin (HDPE), Very Low Density Polyethylene (VLDPE), Linear Low Density Polyethylene (LLDPE), and other materials that prevent waste materials from leaching into surrounding areas. Individual geomembrane liners 10 are arranged to line a containment area, such as a landfill or a slurry pond. Adjacent liners 10 are arranged to partially overlap one another. Overlapping areas are welded together using a known welding system, such as an Agru SP 110-S V3 or Agru SP 250-SV3 welding machine. The welding machine is moved along the overlapping areas of the adjacent liners to create a seam.

Each of the geomembrane liners 10 comprises opposed upper and lower surfaces 12, 14 and side edges 20 extending continuously along the upper and lower surfaces to define a periphery of the geomembrane liners 10. At least one of the side edges 20 of each geomembrane liner 10 is provided with a protective release film 50. The side edge 20 of the geomembrane liner 10 having a protective release film 50 is defined as a weld edge 30.

The protective release film 50 is applied to the geomembrane liner 10 during manufacture of the liner 10 and prior to shipment and installation at the containment site. The protective release film 50 may be applied to both the upper and lower surfaces 12, 14 of the geomembrane liner 10 at the weld edge 30. Alternatively, the protective release film 50 may only be applied to one of the upper and lower surfaces 10, 12 at the weld edge 30. In particular, the protective release film 50 may be applied to the upper surface 10 of the weld edge 30 of a first liner 10 and the lower surface 14 of the weld edge 30 of a second adjacent liner 10 facing the upper surface 12 of the weld edge 30 of the first liner 10. In other words, the protective release film 50 may optionally be applied only to areas of the liners 10 that are sandwiched together during the welding operation.

The protective release film 50 protects the weld edge 30 from accumulating dust and debris prior to and during installation. Dust and debris may disrupt the weld seam and allow contained waste material to leach into the surrounding area. The protective release film 50 is removed prior to or during a welding operation. As a result, the adjacent geomembrane liners 10 are welded together while minimizing or eliminating the presence of dust and debris at the weld edge 30.

The invention further includes a method of installing geomembrane liners 10 having a protective release film 50. The method comprises a first step 100 of arranging a plurality of geomembrane liners 10 having protective release films 50 on weld edges 30 thereof over a containment area, with the weld edges 30 of adjacent liners 10 at least partially overlapping one another. In a second step 200, a welding machine is arranged at a position to weld the weld edges 30 of the adjacent geomembrane liners to each other. In a third step 300, the protective release film 50 is removed from the weld edges 30 of the geomembrane liner 10. In a fourth step 400, the adjacent liners 10 are welded together using known methods and known welding equipment to form an impermeable seam to prevent the distribution of waste material into surrounding areas.

In an alternative to the method described above, the protective release film 50 may be removed incrementally or in sections during the welding step 400 to reduce exposure of the weld edge 30 of the geomembrane liner 10 to field conditions and therefore further reduce the possibility of accumulation of dust and debris at the weld edges 30.

The disclosed lining system and method are particularly well suited for projects or locations with elevated dust conditions, such as phosphate production operations, coal ash storage operations, and precious metal mining operations. Further, the disclosed system and method helps combat dry and windy weather conditions in which fine particles may be distributed on seam areas prior to or during installation. Moreover, the disclosed system and method helps avoid the accumulation of debris on seam areas when liners must be held on site and exposed to the environment for an extended period of time prior to installation.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112.

What is claimed is:

1. A geomembrane lining system, consisting of:

a plurality of geomembrane liners formed from a resin material, each of the plurality of geomembrane liners having opposite upper and lower surfaces and opposite first and second side edges extending between the upper and lower surfaces of each of the geomembrane liners, areas of the upper surface adjacent the first side edge of each of the geomembrane liners defining a first weld area of the respective geomembrane liner, and areas of the lower surface adjacent the second side edge of each of the geomembrane liners defining a second weld area of the respective geomembrane liner;

a first protective release film applied directly to the resin at the first weld area of each of the geomembrane liners; and a second protective release film applied directly to the resin at the second weld area of each of the geomembrane liners, wherein the first and second protective release films are selectively removable from each of the geomembrane liners to expose the resin at the first and the second weld areas of the respective geomembrane liner thereby enabling the resin at the first weld area of one of the geomembrane liners to be welded directly to the resin at the second weld area of another of the geomembrane liners.

2. The geomembrane liner system of claim 1, wherein the geomembrane liners are formed from High Density Polyethylene Resin (HDPE).

3. The geomembrane liner system of claim 1, wherein the geomembrane liners are formed from Very Low Density Polyethylene (VLDPE).

4. The geomembrane liner system of claim 1, wherein the geomembrane liners are formed from Linear Low Density Polyethylene (LLDPE).

* * * * *